US010925461B2

(12) United States Patent
Kim et al.

(10) Patent No.: US 10,925,461 B2
(45) Date of Patent: Feb. 23, 2021

(54) DISHWASHER

(71) Applicant: LG Electronics Inc., Seoul (KR)

(72) Inventors: Seunghun Kim, Seoul (KR); Ilhwan Kim, Seoul (KR); Sangwoo Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 240 days.

(21) Appl. No.: 15/878,027

(22) Filed: Jan. 23, 2018

(65) Prior Publication Data

US 2018/0206699 A1 Jul. 26, 2018

(30) Foreign Application Priority Data

Jan. 26, 2017 (KR) ..... 10-2017-0013008

(51) Int. Cl.
*A47L 15/42* (2006.01)
*A47L 15/00* (2006.01)

(52) U.S. Cl.
CPC ..... *A47L 15/4289* (2013.01); *A47L 15/0015* (2013.01); *A47L 15/0052* (2013.01);
(Continued)

(58) Field of Classification Search
CPC ..... A47L 15/0052; A47L 15/4289; A47L 15/4234; A47L 15/0015; A47L 15/4225; A47L 2501/06; A47L 2501/04
See application file for complete search history.

(56) References Cited

U.S. PATENT DOCUMENTS

2012/0279527 A1 11/2012 Lee
2014/0182625 A1* 7/2014 Lee ..... A47L 15/4221 134/18
(Continued)

FOREIGN PATENT DOCUMENTS

EP 2954828 A1 12/2015
KR 2008006410 A1 1/2008
(Continued)

OTHER PUBLICATIONS

International Search Report and Written Opinion in International Application No. PCT/KR2018/000906, dated Apr. 25, 2018, 12 pages.
(Continued)

*Primary Examiner* — Benjamin L Osterhout
(74) *Attorney, Agent, or Firm* — Fish & Richardson P.C.

(57) ABSTRACT

A dishwasher includes a tub, a spray arm, a sump, a pump body including a partition that partitions the pump body into a first chamber and a second chamber, a communication hole defined in the partition, a pump channel that connects the sump to the first chamber, an arm channel that connects the spray arm to an interior of the second chamber, an impeller located in the second chamber and configured to rotate to supply water to the arm channel, a heating unit configured to heat water stored in the first chamber, a steam channel that connects the first chamber to the tub, and a channel controller configured to, based on rotation of the impeller, supply water that passes through at least one of the sump, the pump channel, the second chamber, or the arm channel to the steam channel to close the steam channel.

19 Claims, 5 Drawing Sheets

(52) U.S. Cl.
CPC ..... *A47L 15/4225* (2013.01); *A47L 15/4234* (2013.01); *A47L 2501/04* (2013.01); *A47L 2501/06* (2013.01)

(56) References Cited

U.S. PATENT DOCUMENTS

| | | | | |
|---|---|---|---|---|
| 2015/0265133 | A1 | 9/2015 | Choi | |
| 2017/0188781 | A1* | 7/2017 | Lee | A47L 15/4234 |
| 2017/0188784 | A1* | 7/2017 | Cho | A47L 15/4244 |
| 2017/0188785 | A1* | 7/2017 | Park | E05C 19/02 |
| 2017/0196432 | A1* | 7/2017 | Kim | A47L 15/4289 |
| 2017/0275927 | A1* | 9/2017 | Park | A47L 15/4259 |
| 2018/0184880 | A1* | 7/2018 | Lee | A47L 15/23 |

FOREIGN PATENT DOCUMENTS

| | | | |
|---|---|---|---|
| KR | 2013071355 | A1 | 6/2013 |
| KR | 1678442 | A1 | 12/2016 |
| WO | WO2016028049 | A1 | 2/2016 |
| WO | WO2017022985 | A1 | 2/2017 |

OTHER PUBLICATIONS

Extended European Search Report in European Application No. 18152742.5, dated May 24, 2018, 9 pages.

* cited by examiner

【Figure 1】
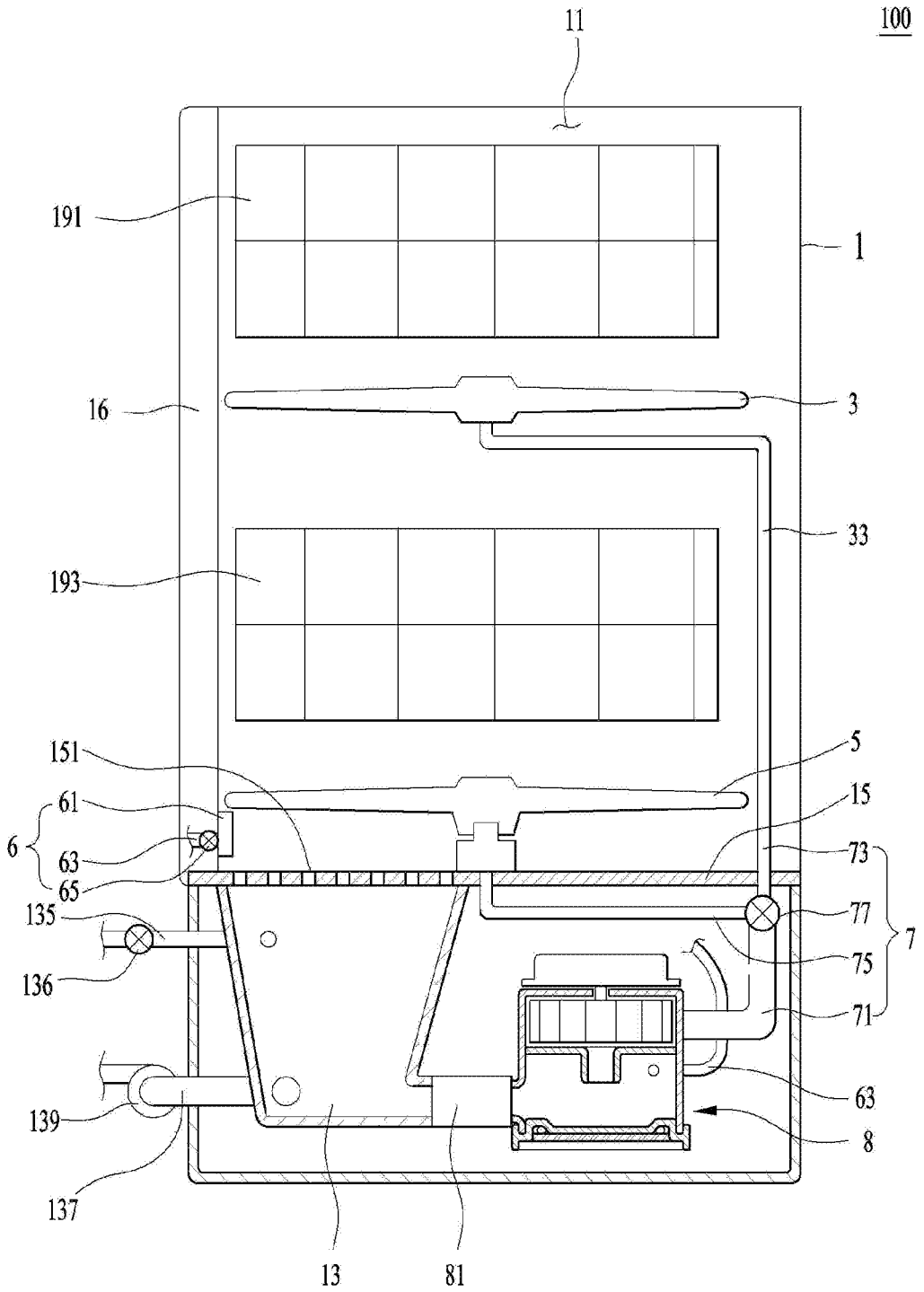

【Figure 2】
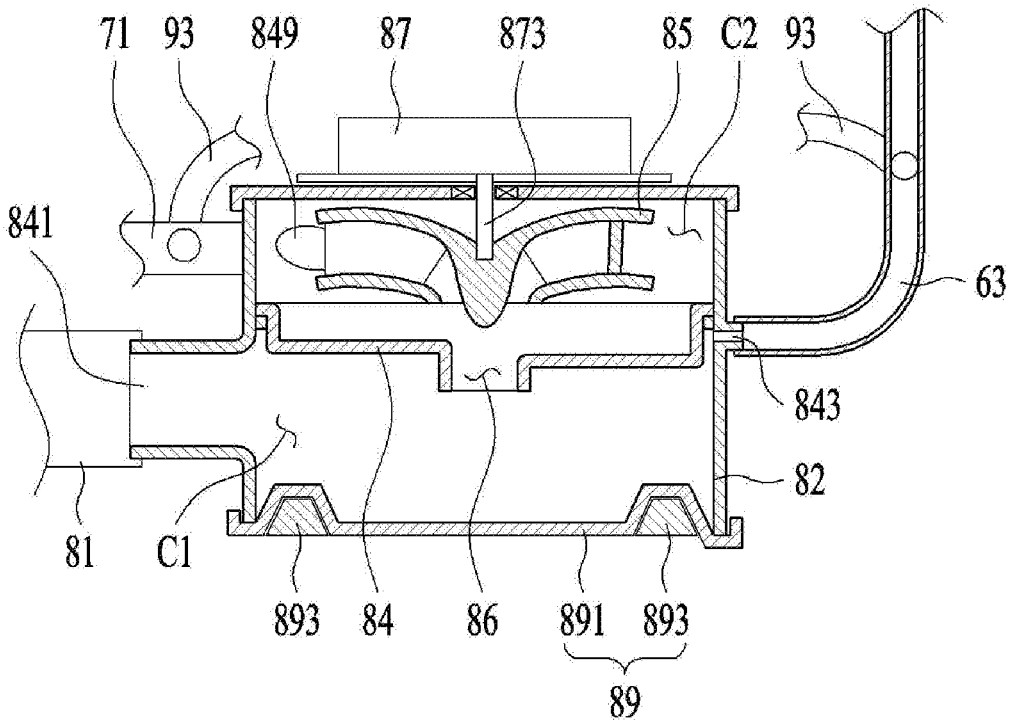

【Figure 3】
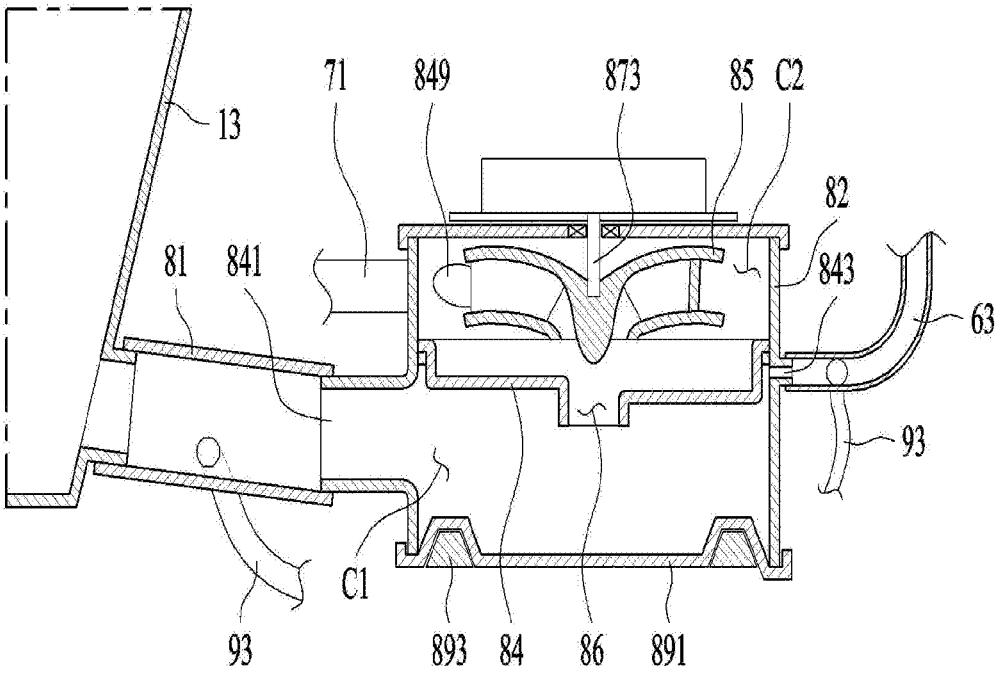

【Figure 4】
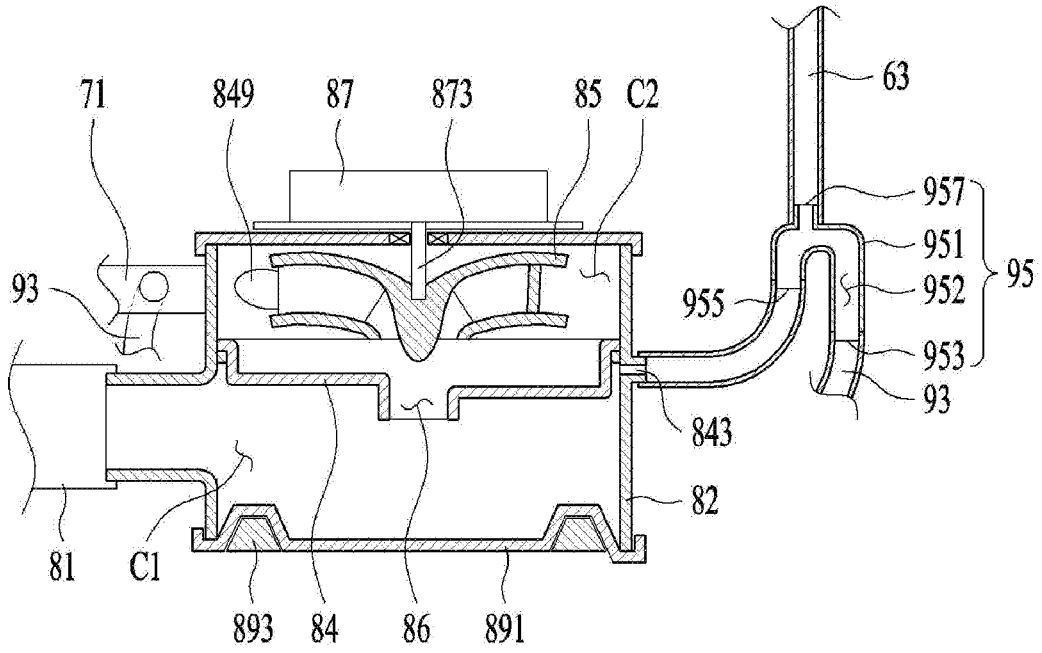

【Figure 5】
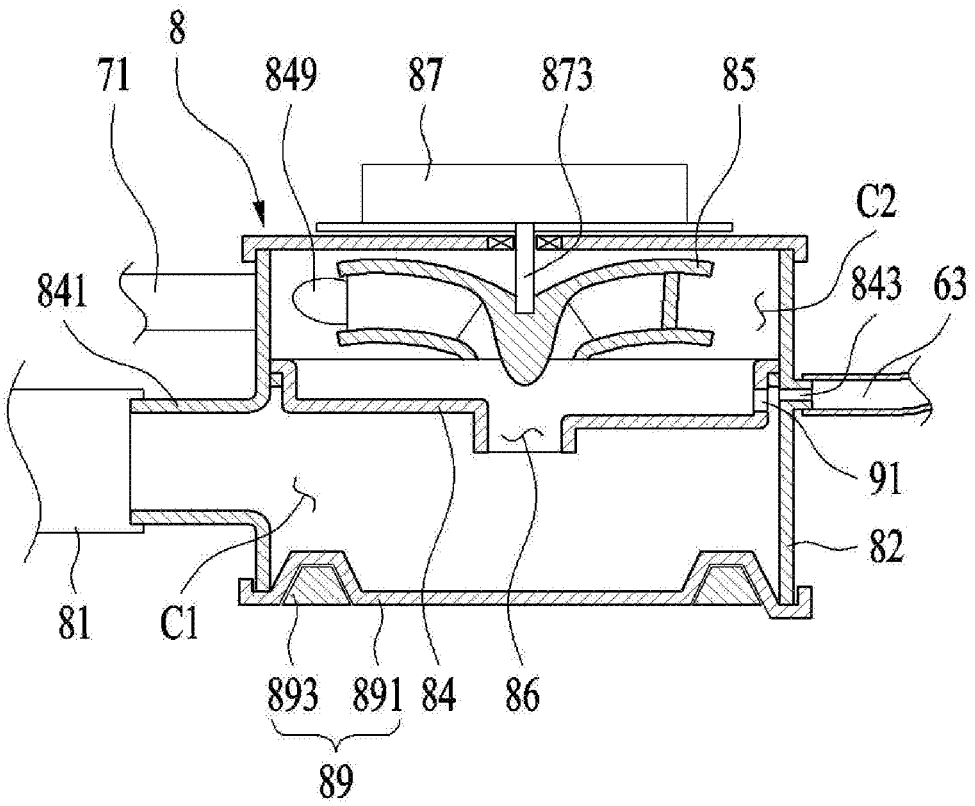

DISHWASHER

TECHNICAL FIELD

The present invention relates to a dishwasher.

BACKGROUND ART

A dishwasher is an electric home appliance that sprays water onto objects to be washed in order to remove foreign matter from the objects. A conventional dishwasher generally includes a tub that defines a washing space, a rack provided in the tub for receiving objects to be washed, a spray arm for spraying water to the rack, a sump for storing water, and a pump for supplying the water stored in the sump to the spray arm.

Meanwhile, some examples of the conventional dishwasher are configured to supply steam to objects to be washed in order to wash, dry, or sterilize the objects. Some examples of the conventional dishwasher that uses steam are configured such that a heater for heating water is provided in a pump. In this case, it is requisite for the dishwasher to include a steam channel that interconnects the pump and the tub. That is, a dishwasher including a heater provided in a pump must include an arm channel that interconnects the pump and a spray arm and a steam channel that interconnects the pump and a tub.

The dishwasher including the heater provided in the pump has the effect of heating water using the heater provided in the pump or supplying steam to the tub. When the pump is operated to supply water to the spray arm, however, the pressure of water is lowered while noise is generated.

That is, the pump supplies water to the arm channel through an impeller rotatably provided in a chamber for storing water. Since the steam channel is provided to interconnect the chamber and the tub, however, air in the tub may be introduced into the tub through the steam channel when the impeller is rotated. If the air is introduced into the chamber through the steam channel, the pressure of the water that is supplied to the spray arm through the arm channel is lowered. In addition, noise is generated when the impeller is rotated.

DISCLOSURE

Technical Problem

An object of the present invention devised to solve the problem lies in a dishwasher including a pump that is capable of performing both a function of supplying steam to objects to be washed and a function of supplying water to the objects.

Another object of the present invention devised to solve the problem lies in a dishwasher that is capable of minimizing a reduction in the pressure of water in a pump that is capable of supplying steam and water to objects to be washed and the generation of noise.

Technical Solution

The object of the present invention can be achieved by providing a dishwasher including a tub for receiving objects to be washed, a spray arm for spraying water to the objects, a sump for storing water, a pump body including a first chamber and a second chamber partitioned by a partition, a communication hole provided in the partition for allowing the first chamber and the second chamber to communicate with each other therethrough, a pump channel for interconnecting the sump and the first chamber to guide the water stored in the sump to the first chamber, an arm channel for interconnecting the interior of the second chamber and the spray arm, an impeller rotatably provided in the second chamber for supplying water to the arm channel, a heating unit for heating water stored in the first chamber, a steam channel for interconnecting the first chamber and the tub, and a channel controller for supplying some of the water that passes through at least one of the sump, the pump channel, the second chamber, or the arm channel to the steam channel in order to close the steam channel when the impeller is rotated.

The channel controller may include a connection channel for interconnecting the arm channel and the steam channel.

The channel controller may include a connection channel for interconnecting the pump channel and the steam channel.

The channel controller may include a connection channel for interconnecting the sump and the steam channel.

The sectional area of the connection channel may be set to be equal to or greater than the sectional area of the steam channel.

The dishwasher may further include a body, a body channel defined in the body for providing a path along which water flows, a first communication part for interconnecting the body channel and the connection channel, a second communication part for interconnecting the body channel and the first chamber, and a third communication part for interconnecting the body channel and the steam channel, wherein the third communication part may be located in a space defined by the body channel between the first communication part and the second communication part.

The third communication part may be located higher than the first communication part and the second communication part.

The dishwasher may further include a door for opening or closing an introduction port formed through the tub and a nozzle fixed to the surface of the door that defines the inner circumferential surface of the tub in a space defined by the door, the nozzle being connected to the steam channel, the nozzle being located higher than the third communication part.

The dishwasher may further include a steam discharge part formed through the first chamber, the steam channel being fixed to the steam discharge part, wherein the channel controller may be provided with a partition through-hole formed through the partition for allowing water to be sprayed to the steam discharge part therethrough when the impeller is rotated.

The sectional area of the partition through-hole may be set to be equal to or greater than the sectional area of the steam discharge part.

The first chamber may be located under the partition, and the second chamber may be located above the partition.

Advantageous Effects

The present invention has the effect of providing a dishwasher including a pump that is capable of performing both a function of supplying steam to objects to be washed and a function of supplying water to the objects.

In addition, the present invention has the effect of providing a dishwasher that is capable of minimizing a reduction in the pressure of water in a pump that is capable of supplying steam and water to objects to be washed and the generation of noise.

DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a view showing an example of a dishwasher according to the present invention; and FIGS. 2 to 5 are views showing embodiments of a channel controller provided in the dishwasher according to the present invention.

BEST MODE

Hereinafter, exemplary embodiments of the present invention will be described with reference to the accompanying drawings. Meanwhile, the configuration of an apparatus or a control method of the apparatus, which will be described below, is merely given to describe the embodiments of the present invention, without being intended to limit the scope of the present invention. The same reference numerals used throughout the specification refer to the same constituent elements.

As shown in FIG. 1, a dishwasher 100 may include a cabinet 1, a tub 11 provided in the cabinet 1 for defining a washing space, spray arms 3 and 5 for spraying water to objects to be washed, and a pump 8 for supplying water to the spray arms 3 and 5.

Racks, in which the objects are received, may be provided in the tub 11. The racks may include an upper rack 191 provided in the upper part of the tub 11 and a lower rack 193 provided in the lower part of the tub 11 (below the upper rack 191).

The cabinet 1 is provided with an introduction port, which is configured to communicate with the tub 11. The introduction port is opened and closed by a door 16, which is provided at one surface of the cabinet 1. When a user opens the door 16 such that the introduction port is opened, therefore, the racks 191 and 193, which are located in the tub 11, may be withdrawn out of the tub 11.

In the case in which the racks include the upper rack 191 and the lower rack 193, the spray arms may include an upper arm 3 for spraying water to the upper rack 191 and a lower arm 5 for spraying water to the lower rack 193.

The water sprayed to the objects by the spray arms 3 and 5 (i.e. the water that has been sprayed into the tub and remains in the tub) may be collected in a sump 13.

The sump 13 is a means provided under the tub 11 for storing water. The sump 13 may be partitioned from the tub 11 through a sump cover 15. In this case, the sump cover 15 may be provided with a collection hole 151, through which the interior of the tub 11 communicates with the interior of the sump 13.

Meanwhile, the sump 13 is connected to a water supply source (not shown) through a water supply channel 135. The water supply channel 135 may be opened and closed by a water supply valve 136, which is controlled by a controller (not shown).

The water stored in the sump 3 is discharged out of the dishwasher through a drainage channel 137 and a drainage pump 139.

The water stored in the sump 13 is supplied to the spray arms 3 and 5 via the pump 8 and an arm channel 7. The arm channel 7 may include a first supply pipe 71 connected to the pump 8, a second supply pipe 73 for interconnecting the first supply pipe 71 and the upper arm 3, and a third supply pipe 75 for interconnecting the first supply pipe 71 and the lower arm 5.

The upper arm 3 may be rotatably coupled to the second supply pipe 73, and the lower arm 5 may be rotatably coupled to the third supply pipe 75.

The second supply pipe 73 and the third supply pipe 75 may diverge from the first supply pipe 71. In this case, a switch valve 77 for opening and closing the second supply pipe 73 and the third supply pipe 75 may be provided at the point at which the second supply pipe 73 and the third supply pipe 75 diverge from the first supply pipe 71.

As shown in FIG. 2, the pump 8 includes a pump body 82 fixed in the cabinet 1, a partition 84 for partitioning the space in the pump body 82 into a first chamber C1 and a second chamber C2, a communication hole 86 formed through the partition 84 for allowing the first chamber C1 and the second chamber C2 to communicate with each other therethrough, and an impeller 85 rotatably provided in the second chamber C2.

The first chamber C1 is provided with a pump introduction part 841, which is formed through the pump body 82. The pump introduction part 841 is connected to the sump 13 through a pump channel 81. Consequently, the water stored in the sump 13 is supplied into the first chamber C1 through the pump channel 81.

The second chamber C2 is provided with a pump discharge part 849, which is formed through the pump body 82. The first supply pipe 71 communicates with the second chamber C2 through the pump discharge part 849.

The impeller 85 is rotated by a motor 87 fixed to the upper surface of the pump body 82. A rotary shaft 873 of the motor 87 is connected to the impeller 85 through the upper surface of the pump body 82.

Meanwhile, a heating unit 89 is provided at the bottom surface of the first chamber C1. In the case in which the pump body 82 is formed in a cylindrical shape having an open lower surface, the heating unit 89 may include a heat transfer part 891 that defines the bottom surface of the first chamber C1 and a heater 893 fixed to the heat transfer part 891 while being located outside the first chamber C1. The heat transfer part 891 may be made of a metal that exhibits high thermal conductivity.

Since the heating unit 89 is provided to define the bottom surface of the first chamber C1, the pump included in the dishwasher according to the present invention is capable of performing both a function of supplying water to the spray arms 3 and 5 and a function of heating water.

Also, in the dishwasher 100 including the pump 8, steam may be supplied to the tub 11 through the heating unit 89 included in the pump 8. To this end, the dishwasher 100 may further include a steam supply unit 6.

As shown in FIG. 1, the steam supply unit 6 may include a nozzle 61 for spraying steam into the tub 11 and a steam channel 63 for interconnecting the nozzle 61 and the first chamber C1.

FIG. 1 shows an example in which the nozzle 61 is provided at the door 16. In this case, the nozzle 61 may be fixed to the lower part of one surface of the door, which defines the inner circumferential surface of the tub.

In the dishwasher 100 having only the structure described above, the pressure of water in the first chamber C1 may be reduced and noise may be generated when the impeller 85 is rotated by the motor 87. The reason for this is that the air in the tub 11 may be introduced into the first chamber C1 through a steam discharge part 843 (see FIG. 2), which communicates with the first chamber C1, and through the steam channel 63, which interconnects the nozzle 61 and the first chamber C1, when the impeller 85 is rotated.

In order to solve this problem, the dishwasher according to the present invention may further include a channel controller 9 for supplying some of the water that passes through at least one of the sump 13, the pump channel 81, the second chamber C2, or the arm channel 7 to the steam channel 63 in order to close the steam channel 63 when the impeller 85 is rotated.

FIG. 2 shows an example in which the channel controller 9 includes a connection channel 93 for interconnecting the arm channel 7 and the steam channel 63. That is, the connection channel 93 shown in FIG. 2 is characterized in that the connection channel 93 supplies some of the water that moves along the first supply pipe 71 to the steam channel 63 in order to close the steam channel 63 when the impeller 85 is rotated.

In order to achieve the above effect, the flow rate in the connection channel 93 may be set to be equal to or greater than the flow rate in the steam channel 63. That is, the sectional area of the connection channel 93 may be set to be equal to or greater than the sectional area of the steam channel 63.

FIG. 3 shows the case in which the channel controller 9 interconnects the pump channel 81 and the steam channel 63. In this case, when the impeller 85 is rotated by the motor 87, the water stored in the sump 13 moves to the pump channel 81. Some of the water introduced into the pump channel 81 moves to the first chamber C1 along the pump channel 81. Some of the water introduced into the pump channel 81 moves to the first chamber C1 via the connection channel 93 and the steam channel 63. In the case in which the sectional area of the connection channel 93 is set to be equal to or greater than the sectional area of the steam channel 63, therefore, the air in the tub 11 is prevented from being supplied to the pump 8 through the steam channel 63 when the impeller 85 is rotated.

Meanwhile, unlike what is shown in FIG. 3, the channel controller 9 may include a connection channel 93 for directly interconnecting the sump 13 and the steam channel 63. Even in this case, the sectional area of the connection channel 93 may be set to be equal to or greater than the sectional area of the steam channel 63.

FIG. 4 shows another embodiment of the channel controller 9. The channel controller 9 according to this embodiment is characterized in that the channel controller 9 further includes a connector 95 for interconnecting the connection channel 93, the steam discharge part 843, and the steam channel 63.

The connector 95 may include a body 951, a body channel 952 defined in the body 951 for providing a path along which water flows, a first communication part 953 for interconnecting the body channel 952 and the connection channel 93, a second communication part 955 for interconnecting the body channel 952 and the steam discharge part 843, and a third communication part 957 for interconnecting the body channel 952 and the steam channel 63.

In this case, the third communication part 957 is located in a space defined by the body channel 952, specifically in a space defined between the first communication part 953 and the second communication part 955. Furthermore, the third communication part 957 is located higher than the first communication part 953 and the second communication part 955. The nozzle 61 is located above the third communication part 957 in the state of being fixed to the door 16. In the case in which the third communication part 957 is located higher than the first communication part 953 and the second communication part 955, therefore, it is possible to minimize the movement of the water, introduced into the body channel 952 through the connection channel 93, to the tub 11 through the steam channel 63.

FIG. 5 shows the case in which the channel controller 9, which is included in the dishwasher according to the present invention, is provided with a partition through-hole 91 formed through the partition 84, which is included in the pump.

The partition through-hole 91 must be located at a position at which some of the water in the second chamber C2 can be supplied to the steam discharge part 843 when the impeller 85 is rotated. In this case, the sectional area of the partition through-hole 91 may be set to be equal to or greater than the sectional area of the steam discharge part 843. The reason for this is that the steam discharge part 843 can be closed by the water discharged from the second chamber C2 through the partition through-hole 91 when the impeller 85 is rotated.

In the dishwasher 100 having the above-stated structure, the steam channel 63 is closed by water when the impeller 85 is rotated. As a result, air in the tub 11 is prevented from being introduced into the first chamber C1 through the steam channel 63. Consequently, it is possible to minimize a reduction in the pressure of water in the pump 8 when the pump 8 is operated and to minimize the generation of noise.

What is claimed is:

1. A dishwasher comprising:

a tub that defines a space configured to receive objects to be washed;

a spray arm located in the space and configured to spray water to the objects;

a sump configured to store water;

a pump body connected to the sump, the pump body comprising a partition that partitions the pump body into a first chamber and a second chamber;

a communication hole defined in the partition and configured to allow the first chamber and the second chamber to communicate with each other;

a pump channel that connects the sump to the first chamber and that is configured to supply water from the sump to the first chamber;

an arm channel that connects the spray arm to an interior of the second chamber;

an impeller located in the second chamber and configured to rotate to supply water to the arm channel;

a heating unit configured to heat water stored in the first chamber;

a steam channel that connects the first chamber to the tub; and a connection channel configured to guide, to the steam channel, at least a portion of water that passes through at least one of the sump, the pump channel, the second chamber, or the arm channel based on rotation of the impeller such that the guided water blocks air from entering the first chamber through the steam channel.

2. The dishwasher according to claim 1, wherein the first chamber is located vertically below the partition, and the second chamber is located vertically above the partition.

3. The dishwasher according to claim 1, wherein the connection channel connects the steam channel to the arm channel.

4. The dishwasher according to claim 3, wherein the connection channel has a sectional area that is greater than or equal to a sectional area of the steam channel.

5. The dishwasher according to claim 1, wherein the connection channel connects the steam channel to the pump channel.

6. The dishwasher according to claim 5, wherein the connection channel has a sectional area that is greater than or equal to a sectional area of the steam channel.

7. The dishwasher according to claim 1, wherein the connection channel connects the steam channel to the sump.

8. The dishwasher according to claim 7, wherein the connection channel has a sectional area that is greater than or equal to a sectional area of the steam channel.

9. The dishwasher according to claim 1, wherein a volume of the first chamber is greater than or equal to a volume of the second chamber.

10. The dishwasher according to claim 1, wherein the connection channel has a sectional area that is greater than or equal to a sectional area of the steam channel.

11. The dishwasher according to claim 10, further comprising a connector that comprises:

a body;

a body channel defined in the body and configured to guide flow of water;

a first communication part that connects the body channel to the connection channel;

a second communication part that connects the body channel to the first chamber; and a third communication part that connects the body channel to the steam channel, wherein the third communication part is connected to the body channel between the first communication part and the second communication part.

12. The dishwasher according to claim 11, wherein the third communication part is located vertically above the first communication part and the second communication part.

13. The dishwasher according to claim 12, further comprising:

an introduction port defined at the tub;

a door configured to open or close at least a portion of the introduction port; and a nozzle coupled to a surface of the door that defines an inner surface of the tub, wherein the nozzle is connected to the steam channel and located vertically above the third communication part.

14. The dishwasher according to claim 1, further comprising a steam discharge part that is defined at the first chamber, that passes through the first chamber, and that is coupled to the steam channel, wherein the connection channel includes a partition through-hole defined at the partition and configured to, based on rotation of the impeller, allow water to be sprayed to the steam discharge part through the partition through-hole.

15. The dishwasher according to claim 14, wherein a sectional area of the partition through-hole is greater than or equal to a sectional area of the steam discharge part.

16. The dishwasher according to claim 14, wherein the partition through-hole is configured to communicate with the second chamber.

17. The dishwasher according to claim 14, wherein the partition comprises:

a first portion that faces toward a bottom surface of the first chamber and that defines the communication hole; and a second portion that extends from the first portion, that faces toward a side surface of the first chamber that defines the steam discharge part, and that defines the partition through-hole.

18. The dishwasher according to claim 17, wherein the second portion of the partition is located vertically above the first portion of the partition.

19. The dishwasher according to claim 17, wherein the steam discharge part is located vertically above the first portion of the partition.

* * * * *